US005109142A

United States Patent [19]

von Kannewurff et al.

[11] Patent Number: 5,109,142

[45] Date of Patent: Apr. 28, 1992

[54] CIRCUIT BREAKER HANDLE TIE FOR AUTOMATED ASSEMBLY

[75] Inventors: Michael C. von Kannewurff, Middlebury; Richard E. Bernier, Southington; Samuel E. Eskridge, Branford, all of Conn.

[73] Assignee: General Electric Company, New York, N.Y.

[21] Appl. No.: 661,945

[22] Filed: Feb. 28, 1991

[51] Int. Cl.[5] ..... H01H 9/20; H01H 33/46

[52] U.S. Cl. ..... 200/50 R; 200/50 C; 335/8

[58] Field of Search ..... 200/50 R, 50 C; 337/8, 337/9, 10, 11

[56] References Cited

U.S. PATENT DOCUMENTS

| | | | |
|---|---|---|---|
| 3,109,899 | 11/1963 | Pastene | 200/42 |
| 4,679,016 | 7/1987 | Ciarcia et al. | 335/132 |
| 4,731,921 | 3/1988 | Ciarcia et al. | 29/622 |
| 4,980,525 | 12/1990 | Kakisako | 200/50 |

*Primary Examiner*—Harold Broome

*Attorney, Agent, or Firm*—Richard A. Menelly; Fred Jacob

[57] ABSTRACT

Single pole circuit breakers are connected in a modular array to provide up to four poles by means of a handle tie bar assembly. The circuit breaker operating handles are grooved to receive a metal interlocking pin and a plastic tie bar to cause the circuit breakers to move in unison. A locking clip arranged between one of the operating handle slots and the tie bar assembly prevents the circuit breakers from being turned from their OFF-to-ON or ON-to-OFF conditions.

12 Claims, 1 Drawing Sheet

CIRCUIT BREAKER HANDLE TIE FOR AUTOMATED ASSEMBLY

BACKGROUND OF THE INVENTION

U.S. Pat. No. 4,731,921 entitled "Method of Fabricating a Molded Case Circuit Breaker" describes a circuit breaker operating mechanism designed for automated assembly. From a single pole unit, a multi-pole unit is assembled by fastening the required number of the single pole units in a side-by-side modular array. With the increased use of four pole circuit breakers within industrial-rated electric power distribution systems, it is economically advantageous to gang four single pole circuit breakers together and interlock the circuit breakers by means of a handle tie bar assembly.

The use of a tie bar assembly for providing a multi-pole array of single pole circuit breakers is described, for example, in U.S. Pat. No. 4,980,525. The single pole circuit breakers, are ganged together by means of an elongated rivet and are interlocked by means of a handle tie bar to lock the circuit breaker operating handles together and to force them to move together in unison. A hole is formed perpendicular to the vertical extent of each upstanding circuit breaker operating handle and an elongated connecting pin is inserted through the holes of each of the circuit breaker operating handles. A plastic tie bar is then positioned over the operating handles and the interlocking pin to complete the multi-pole assembly.

In the automated assembly of circuit breaker components, it is desirable to assemble the circuit breaker components in a "down-loaded" assembly operation. The down-loaded assembly process facilitates the use of robots at a substantial cost savings. It has been determined however, that the placement of an interlocking pin through the holes in the circuit breaker operating handles in the plane perpendicular to the vertical extent of the upstanding circuit breaker handles, is not easily replicated within an automated assembly process.

As described within U.S. Pat. No. 3,109,899, it is often required to lock a circuit breaker operating handle in its "OFF" position to ensure that the circuit breaker contacts remain open when work is being performed on the associated electrical equipment. The lock described within this Patent comprises a flexible locking clip that is interposed between the operating handle and the associated operating handle slot to prevent the circuit breaker handle from being moved within the slot. The clip can also be used to lock the circuit breaker in the "ON" position to prevent accidental disruption of power flow to critical equipment.

When several single pole circuit breakers are ganged together in the multi-pole array described within the aforementioned U.S. Pat. No. 4,980,525 a separate locking clip must be used with each one of the circuit breaker operating handles to ensure that all of the circuit breaker operating handles remain in their OFF position.

Accordingly, one purpose of this invention is to provide a multi-pole array of circuit breakers utilizing an automatically assembled tie bar assembly which requires a single locking clip to maintain the individual circuit breakers in their ON or OFF position.

SUMMARY OF THE INVENTION

The invention comprises an automatically assembled multi-pole circuit breaker operating handle tie bar assembly consisting of a metal interlocking pin and insulated plastic tie bar. The interlocking pin is down-loaded within slotted circuit breaker operating handles and the tie bar is then down-loaded over the interlocked circuit breaker operating handles. The tie bar assembly is conveniently interlocked by means of a single plastic locking clip that snappingly engages the tie bar and seats within anyone of the associated circuit breaker operating handle access slots.

DESCRIPTION OF THE PREFERRED EMBODIMENT

Figure 1:
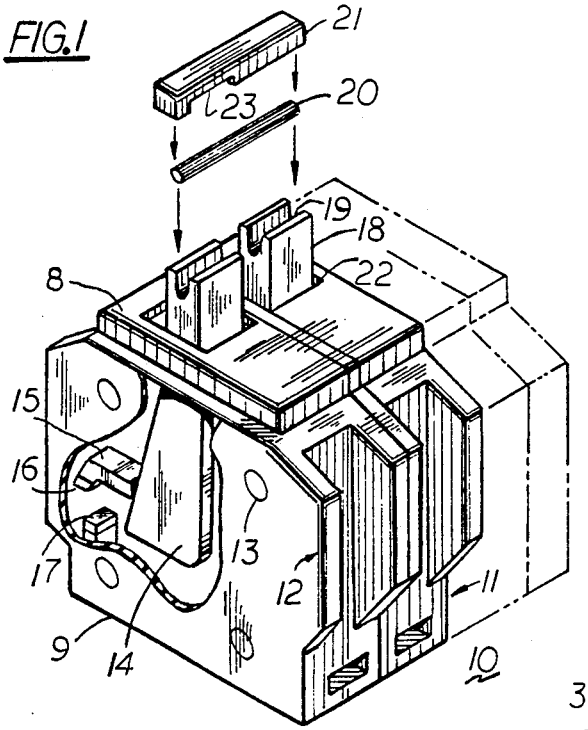
FIG. 1 is a top perspective view of a plurality of single pole circuit breakers interlocked to form a multi-pole array with the tie bar and interlocking pin of the invention arranged in isometric projection.

A two-pole circuit breaker 10 is shown in FIG. 1 and consists of a single pole circuit breaker 11 that is attached to a similar circuit breaker 12 by means of four rivets 13. As indicated in phantom, up to four such circuit breakers can be fastened together to produce an effective 2, 3 or 4-pole circuit breaker. Each such circuit breaker is similar to that described within the aforementioned U.S. Pat. No. 4,679,016 and includes an operating mechanism 14 that controls the movable contact arm 15 to position the attached movable contact 16 in and out of abutment with the corresponding fixed contact 17 An operating handle 18 extends through a slot 22 formed in the cover 8 of the circuit breaker which is fastened to the circuit breaker case 9. To facilitate the downward assembly of the metal interlocking pin 20, each of the circuit breaker operating handles 18 terminates in a U-shaped slot 19. The circuit breakers are accordingly interlocked by positioning the metal interlocking pin within the associated U-shaped slots of each of the circuit breakers that form the multi-pole circuit breaker 10. A plastic tie bar 21 is next positioned over the metal pin and the operating handles to ensure that each of the operating handles moves in unison when the plastic tie bar 21 is rotated to turn the circuit breaker contacts between their ON and OFF positions. A rectangular slot 23 is formed through both sides of the plastic tie bar 21 to facilitate the use of a locking clip 35 (FIG. 2).

Figure 1A:
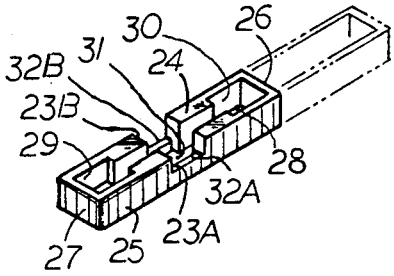
FIG. 1A is an enlarged top perspective view of the tie bar of FIG. 1.

The plastic tie bar 21 depicted in FIG. 1A, is in the form of a trough-shaped rectangle composed of opposing side walls 24, 25 joined by complementary opposing end walls 26, 27 and an extensive bottom 28. The plastic tie bar 21 can have various lengths to accommodate up to four interlocked circuit breakers, as indicated in phantom. The ends of each one of the circuit breaker operating handles are received within the large recesses 29, 30 that are closed by means of the bottom 28. A small recess 31 is formed intermediate the large recesses to accommodate the metal pin 20 shown earlier in FIG. 1 while the rectangular slots 23A, 23B formed in the opposing side walls each define a corresponding ledge 32A, 32B that interact with the locking clip 35 which is best seen by referring now to the interlock circuit breaker 10 depicted in FIG. 2.

The locking clip 35 is formed from a flexible thermoplastic composition and has a J-shaped configuration consisting of a long leg 36 that is joined to an opposing short leg 37 by means of the intermediate bight portion 38. The locking clip 35 includes a protection 33 having an end part 33A that interacts with one of the rectangular slots 32A formed within the plastic tie bar 21 in the manner to be discussed below in greater detail. A lip 34 formed at the end of the short leg 37 also interacts with a similar slot 23B (FIG. 2) formed on the opposite side wall of the plastic tie bar 21. The bottom end 36A of the long leg 36 fits within the slot 22 of the operating handle 18 of the single pole circuit breaker 12 when the locking clip 35 is positioned over the plastic tie bar 21 in press-fit relation and is retained on the plastic tie bar by snappingly engaging the ledge 32A formed on the rectangular slot 23A with the top 33A of the projection 33 formed on the locking clip 35.

Figure 2A:
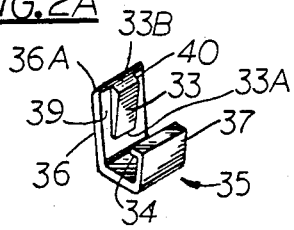
FIG. 2A is an enlarged top perspective view of the locking clip of FIG. 2.
Figure 2:
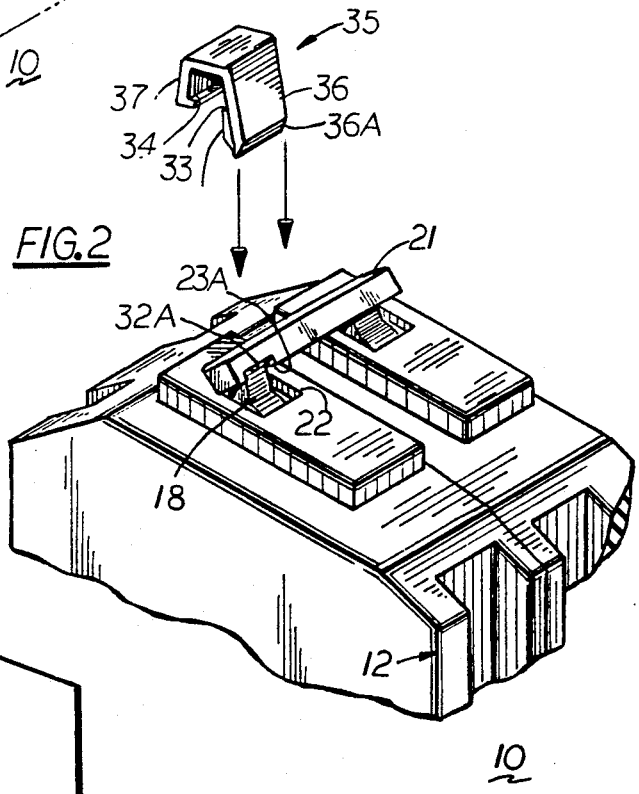
FIG. 2 is a top perspective view of the multi-pole circuit breaker array of FIG. 1 after assembly of the interlocking pin and tie bar and with the locking clip according to the invention arranged in isometric projection.

The locking clip 35 is shown inverted in FIG. 2A to detail the lip 34 at the end of the short leg 37 and to more clearly depict the projection 33 extending inwardly from the long leg 36. The end part 33A is formed at one end while the opposite end 33B tapers downwardly towards the end 36A of the long leg 36. This facilitates guiding the end 36A of the long leg into the handle slot 22 shown earlier in FIG. 2. A pair of surfaces 39, 40 are formed on the opposite sides of the projection 33 to receive the thumb and forefinger of an operator to facilitate grasping and removing the locking clip from the plastic tie bar.

Figure 3:
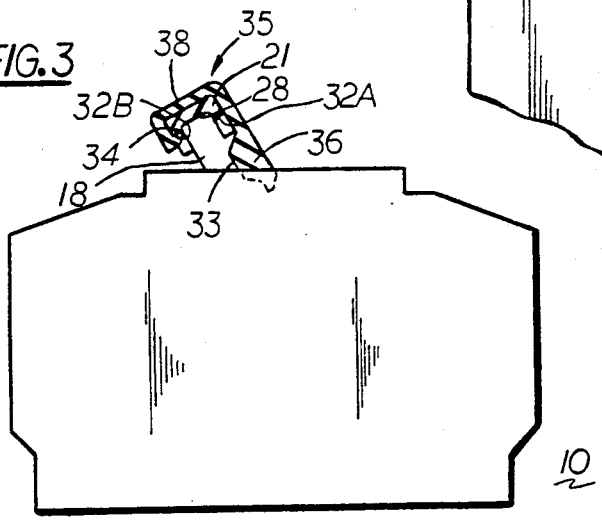
FIG. 3 is a side view of the multi-pole circuit breaker array of FIG. 2 after assembly of the tie bar, the interlocking pin and the locking clip.

The capture of the lip 34 at the bottom end of the short leg of the locking clip 35 by the ledge 32B formed within the rectangular slot to hold the locking clip against the plastic tie bar is best seen by referring now to the multi-pole circuit breaker 10 depicted in FIG. 3. The bight portion 38 of the locking clip 35 engages the exterior of the bottom 28 in press-fit relation to lockingly hold the locking clip onto both the plastic tie bar 21 and the circuit breaker operating handle 18. The capture between the ledge 32A on the plastic tie bar 21 and the top of the projection 33 on the long leg 36 of the locking clip 35 provides further means for holding the locking clip against the plastic tie bar.

To indicate that the circuit breaker handles are in a locked-ON or OFF condition, the locking clip can be coated with or made from a caution-color such as red or orange, while the plastic tie bar can be coated with or made from a neutral color, such as black or grey.

Means have been described herein for the modular build-up of a multi-pole circuit breaker from a single multi-pole circuit breaker design. U-shaped grooves formed at the ends of the circuit breaker operating handles receive a metal interlocking pin to hold the circuit breaker handles together while a plastic tie bar arranged over the operating handles and the tie bar causes the operating handles to move in unison. A single locking clip in the nature of a J-shaped flexible plastic unit cooperates with the operating handle slot in the circuit breaker cover and with two parts of the plastic handle tie bar to prevent the circuit breakers from being turned from their OFF and ON positions.

Having thus described our invention, what we claim as new and desire to secure by Letters Patent is:

1. A circuit breaker adapted for multi-pole operation comprising in combination:

a plastic case and attached plastic cover;

an operating mechanism within said case separating a pair of contacts upon occurrence of an overcurrent condition through a protected circuit;

a first operating handle having one end interacting with said operating mechanism and an opposite end extending through a slot in said cover providing manual across to said operation mechanism for opening and closing said contacts under quiescent current conditions through said protected circuit, said first operating handle having a first groove formed within said opposite ends, said first groove adapted for arranging next to a second groove formed within a second operating handle on a second circuit breaker whereby a connecting pin within said first and second grooves cause said first and second operating handles to move in unison with each other a plastic tie bar arranged over said opposite ends of said first and second operating handles an said connecting pin thereby providing support to said first and second operating handles, said tie bar comprising a trough-shaped configuration including an opposing pair of side walls and end walls, said first and second operating handles and said connecting pin being arranged within said sidewalls and said end walls; and a locking clip having a J-shaped configuration, defining a short and a long leg joined by a bight, an end of said long leg being retained within said cover slot to thereby lock said first operating handle in an open or closed position.

2. The circuit breaker of claim 1 wherein said first and second grooves are integrally-formed within said opposite ends of said first and second handles.

3. The circuit breaker of claim 1 wherein said plastic tie bar includes a first rectangular slot formed within one of said side walls, and end part of said short leg being retained within said first rectangular slot to thereby lock said second operating handle in said open position.

4. The circuit breaker of claim 3 wherein said tie bar comprises a first color and said clip comprises a different color from said first color to indicate that said clip is arranged on said tie bar and that said first and second handle operators are locked in said open positions.

5. The circuit breaker of claim 5 wherein said end part of said short end terminates in a lip, said lip being retained by a part of said first rectangular slot.

6. The circuit breaker of claim 1 including a projection formed within an inner surface of said long leg, said projection interacting with a part of a second rectangular slot formed on an opposite one of said side walls.

7. A circuit breaker operating handle tie bar comprising:

a unitary plastic rectangle having a trough-shaped configuration open at a top and closed at a bottom thereof;

a pair of opposing side walls and a pair of opposing end walls defining said rectangle;

a pair of first and second wide recesses formed within said rectangle adapted for receiving end parts of a corresponding pair of circuit breaker operating handles;

a narrow slot intermediate said first and second wide recesses, said narrow slot being adapted for receiving a connecting pin extending between said first and second circuit breaker operating handles; and a rectangular slot formed within one of said side walls, said rectangular slot being adapted to receive one end of a locking clip.

8. The circuit breaker operating handle tie bar of claim 7 wherein said locking clip comprises a J-shaped configuration having a long leg and a short leg separated by a bight, said short leg being adapted for insertion within said rectangular slot and said long leg being adapted for insertion within an operating handle slot formed within a circuit breaker cover.

9. The circuit breaker operating handle tie bar of claim 7 wherein said plastic rectangle comprises one color and said locking clip comprises a different color to indicate when said locking clip is arranged on said plastic rectangle.

10. The circuit breaker operating handle tie bar of claim 7 wherein said locking clip includes a projection formed on an inner surface of said long leg, one end of said projection lockingly receiving one edge of said rectangle.

11. The circuit breaker operating handle tie bar of claim 10 wherein an opposite end of said projection is tapered to facilitate entrance of one end of said long leg within said operating handle slot.

12. The circuit breaker of claim 11 including a pair of surfaces formed on said inner surface of said long leg, one opposing side of said projection for facilitating manual removal of said locking clip from said rectangle.

* * * * *

UNITED STATES PATENT AND TRADEMARK OFFICE

CERTIFICATE OF CORRECTION

PATENT NO. : 5,109,142

DATED : April 28, 1992

INVENTOR(S) : von Kannewurff et al.

It is certified that error appears in the above-identified patent and that said Letters Patent is hereby corrected as shown below:

Column 4 --

IN THE CLAIMS:

Claim 1, line 12, change "across" to --access--;
change "operation" to --operating--
line 24, change "an" to-and--.

Claim 5, line 1, change "5" to --3--.

Signed and Sealed this

Twenty-second Day of June, 1993

Michael K. Kirk

MICHAEL K. KIRK

*Acting Commissioner of Patents and Trademarks*

*Attest:*

*Attesting Officer*